US006758446B2

(12) United States Patent
Bjornrud

(10) Patent No.: US 6,758,446 B2
(45) Date of Patent: Jul. 6, 2004

(54) TOOTHBRUSH HOLDER/STAND

(76) Inventor: Donald Bjornrud, 1420 Kingsley, Mt. Clemens, MI (US) 48043

( * ) Notice: Subject to any disclaimer, the term of this patent is extended or adjusted under 35 U.S.C. 154(b) by 0 days.

(21) Appl. No.: 10/436,519

(22) Filed: May 13, 2003

(65) Prior Publication Data

US 2003/0213877 A1 Nov. 20, 2003

Related U.S. Application Data

(60) Provisional application No. 60/380,729, filed on May 15, 2002.

(51) Int. Cl.[7] ..... A46B 17/02

(52) U.S. Cl. ..... 248/110; 15/167.1; 15/248.1; 248/351

(58) Field of Search ..... 248/110, 152, 248/176.1, 351, 357, 309.1, 312, 37.3, 37.6, 688 R; 211/60.1, 65, 68, 69.1, 70.7, 70.1; 15/248.1 R, 167.1

(56) References Cited

U.S. PATENT DOCUMENTS

| | | | | | |
|---|---|---|---|---|---|
| 569,936 | A | * | 10/1896 | Potter | 15/435 |
| 1,982,589 | A | * | 11/1934 | Bergstrom | 132/73 |
| 2,639,081 | A | * | 5/1953 | Metzger | 211/70.1 |
| 2,916,155 | A | * | 12/1959 | Elliott | 211/65 |
| 3,685,660 | A | * | 8/1972 | Saunders | 211/70.1 |
| 3,794,181 | A | * | 2/1974 | Canham | 211/65 |
| 3,884,635 | A | | 5/1975 | Sloan | |
| 3,968,950 | A | * | 7/1976 | Gallo | 248/110 |
| 4,259,761 | A | * | 4/1981 | Earle | 15/143.1 |
| 4,616,749 | A | * | 10/1986 | Briggs | 206/315.2 |
| D293,488 | S | * | 12/1987 | Emmons | D28/38 |
| 4,770,379 | A | | 9/1988 | Estvold | |
| 4,880,020 | A | | 11/1989 | Schurgin | |
| 4,995,515 | A | * | 2/1991 | Smith | 211/65 |
| 5,297,677 | A | | 3/1994 | Burian et al. | |
| 5,480,027 | A | | 1/1996 | Leonard | |
| D370,147 | S | | 5/1996 | Petronio | |
| 5,573,019 | A | | 11/1996 | Hempel | |
| 5,660,285 | A | | 8/1997 | Tooma | |
| 5,769,245 | A | | 6/1998 | Butler | |
| D398,450 | S | * | 9/1998 | Blue | D4/113 |
| 5,875,516 | A | * | 3/1999 | Blue | 15/248.1 |
| 6,101,660 | A | | 8/2000 | Mroczka et al. | |
| 2001/0003332 | A1 | | 6/2001 | Ventnor | |

FOREIGN PATENT DOCUMENTS

| | | | |
|---|---|---|---|
| FR | 2380754 | A | * 10/1978 |

* cited by examiner

*Primary Examiner*—Anita M. King
(74) *Attorney, Agent, or Firm*—Harness, Dickey & Pierce, PLC

(57) ABSTRACT

A portable toothbrush holding device for sanitarily holding a toothbrush having a generally planar shape manufactured from a rigid polymer, such as acrylic resin, embodying a predefined shape with at least one linear edge for resting on a planar surface such as a counter or lavatory basin. The toothbrush holder comprises one or more holes there through for the passage of a toothbrush handle. The distal end of the toothbrush handle rests upon the surface such as a counter or lavatory basin, while the bristle end of the toothbrush is elevated off the counter surface due to the propping action of the toothbrush holder, positioned proximate to the bristle end of the toothbrush.

1 Claim, 2 Drawing Sheets

TOOTHBRUSH HOLDER/STAND

CROSS-REFERENCE TO RELATED APPLICATIONS

This application claims the benefit of U.S. Provisional Application No. 60/380,729, filed on May 15, 2002.

FIELD OF THE INVENTION

The present invention relates to a toothbrush holder. More specifically this invention relates to a portable toothbrush holder for sanitarily holding a toothbrush, and protecting the bristles.

BACKGROUND OF THE INVENTION

Toothbrushes have become an important device for maintaining oral hygiene, and preventing diseases of the gums and teeth. Due to their intra-oral use, it is important to maintain sanitation, and prevent contact with potential disease and bacteria covered surfaces found around a lavatory basin wherein one would typically use a toothbrush. Often, the toothbrush is laid upon the rim of a lavatory basin, which allows contact of the bristle portion of the brush with the surface of the lavatory basin, providing for the transfer of bacteria from the basin surface to the brush, and subsequently, to the users mouth. Furthermore, due to the design of most toothbrushes, they are prone to falling off surfaces such as the lavatory basin, and coming in contact with the floor, which is another highly potential bacterial carrier.

In addition to possible contamination resulting from simply resting a toothbrush on a counter or basin, over time the bristle elements of the brush may become deformed, or worn from repeated falls from the basin, and possible breakage of the toothbrush may result, shortening the useful life for the toothbrush.

A toothbrush is routinely taken along on trips so that oral hygiene can be continued while away from home. During travel, the toothbrush is usually protected by a travel container. To conserve space, the travel container closely conforms to the external shape of the toothbrush. Once at the destination, the toothbrush is removed from the travel container and stored, often on the lavatory basin itself, resulting in exposure to unknown and possibly unsanitary bacteria or disease. The present invention overcomes these shortcomings in providing a portable toothbrush stand that is simple to manufacture and allows for the sanitary protection of a toothbrush.

SUMMARY OF THE INVENTION

Briefly described, the present invention comprises a portable toothbrush holder, suitable for home use or travel, whereby a toothbrush can be held in a clean environment with the bristles of the brush exposed for drying.

It is an object of the present invention to provide for a sanitary means of holding a toothbrush, upon a surface being a high potential bacterial carrier such as a lavatory basin.

It is another object of the present invention to provide a compact, easily transportable means of holding a toothbrush sanitarily for use in travel.

Still another object of the invention is to provide a new and improved toothbrush holder which affords less susceptibility to contamination and damage of toothbrush bristles attributed to falling off a lavatory sink basin onto the floor.

A further object of the invention to provide a new and improved toothbrush holder for preventing the contamination and deformation of toothbrush bristles, that is both economic and simple to manufacture.

The foregoing objects of the present invention are accomplished in the preferred embodiment of the invention by a generally planar toothbrush holder, comprised of a predetermined polymer such as acrylic, and having a predefined shape with at least one linear edge, or in the alternative, at least two corresponding points for resting on a surface such as a counter or sink basin. The toothbrush holder further comprises one or more holes there through for the passage of a toothbrush handle. When the toothbrush is stored, the distal end of the toothbrush handle rests upon the surface such as a counter or lavatory basin, while the bristle end of the toothbrush is elevated off the counter surface due to the propping action of the toothbrush holder, positioned proximate to the bristle end of the toothbrush.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION OF THE PREFERRED EMBODIMENTS

Figure 1:
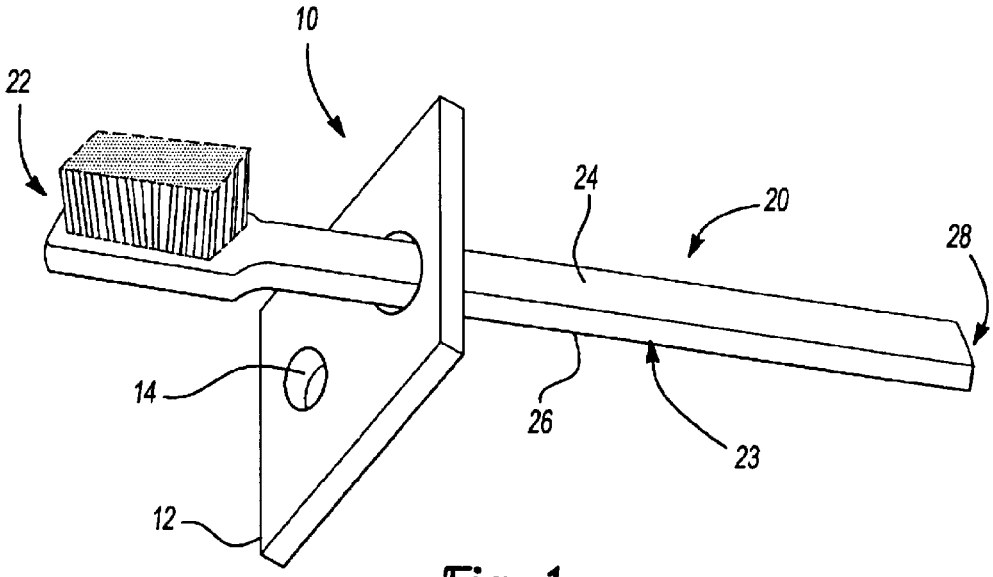
FIG. 1 is a perspective side view of the toothbrush holder holding a toothbrush accordingly.

The following description of the preferred embodiment(s) is merely exemplary in nature and is in no way intended to limit the invention, its application, or uses. Furthermore, like reference numeral represent identical or corresponding elements throughout the different figures.

As illustrated in FIG. 1, when a toothbrush 20 is not in use, it is desirable to store in a manner so as to keep the bristle end 22, which is the portion used intra-orally, from contacting the lavatory basin or counter upon which the toothbrush rests, resulting in possible bacterial transfer from the basin to the toothbrush 20, and subsequently to the users oral cavity. To achieve this desired protection, FIG. 1 illustrates one embodiment of the present invention representing a toothbrush holder generally designated as numeral 10, for sanitarily holding the bristle end 22 of a toothbrush 20 elevated off the surfaces of a lavatory basin or counter. The toothbrush holder 10, comprised of a rigid polymer such as acrylic, is of general planar shape, having a lower edge 12 and at least one aperture 14 there through.

Figure 2:
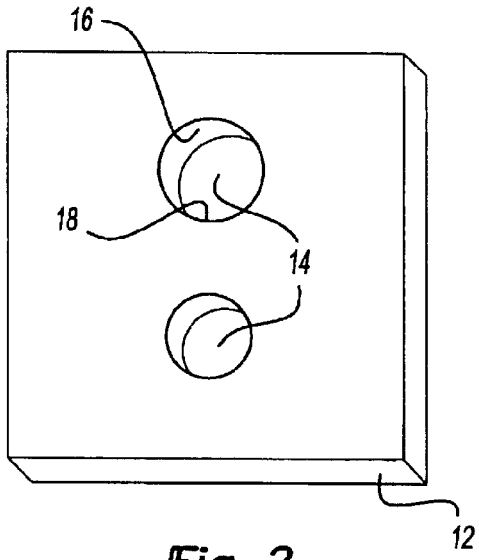
FIG. 2 is a perspective planar-view of the toothbrush holder of FIG. 1 without the toothbrush.

Referring now to the illustration in FIG. 2, the aperture 14 of the toothbrush holder 10 has generally top inside surface 16, and a lower inside surface 18 for engaging with the top side 24 and bottom side 26 respectively, of the toothbrush handle 23 when the handle 23 of the toothbrush 20 is inserted through the aperture 14. The aperture 14 is of a diameter greater than that of the toothbrush handle 23, allowing passage there through of the handle 23 of the toothbrush 20. Multiple apertures 14 may be embodied in the toothbrush holder 10, having varying diameters, to accommodate toothbrushes 20 having a handle 23 of a varying width or diameter. At least one of the apertures 14 is of a diameter greater than that of the toothbrush handle 23, allowing for ease of insertion or removal of the toothbrush handle 23 from the toothbrush holder 10.

Once the toothbrush handle 23 is inserted into the aperture 14 the tdothbrush holder 10 forms a prop for the toothbrush 20, by the creation of a wedging effect when the top side. 24 of the handle 23 contacts the top inside surface 16 of the aperture 14, and the bottom side 26 of the handle 23 contacts the lower inside surface 18 of the aperture 14. The toothbrush 20 and toothbrush holder 10 may then be simply placed upon the desired resting surface, with only the lower edge 12 of the toothbrush holder 10 and the distal end 28 of the toothbrush handle 23 contacting the resting surface, leaving the bristle end 22 elevated off the lavatory basin.

The generally open design of the toothbrush holder permits not only the bristle end 22 of the toothbrush 20 to be positioned so as to expose them for drying, but also permits the handle 23 to be ventilated for drying as well.

Figure 3:
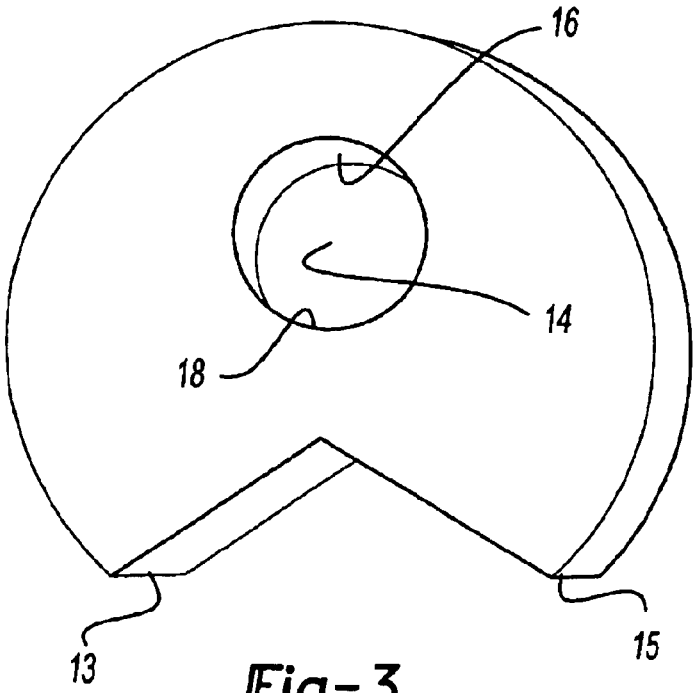
FIG. 3 is a perspective planar view of an alternative embodiment of the toothbrush holder.
Figure 4:
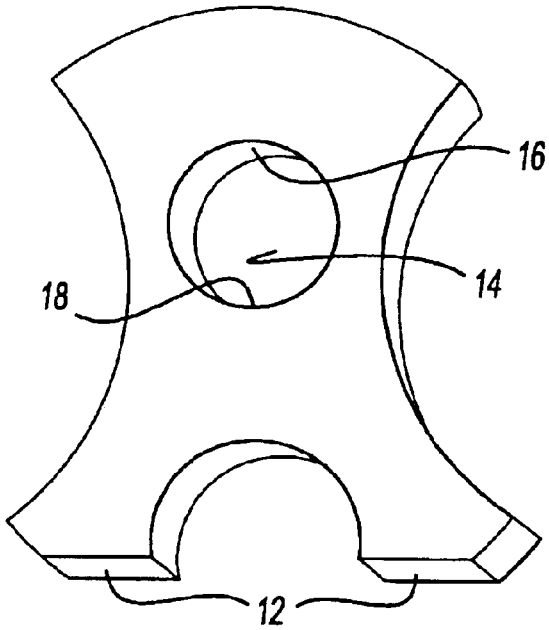
FIG. 4 is a perspective planar view of another alternative embodiment of the toothbrush holder.

FIGS. 3 and 4 illustrate possible alternative embodiments of the toothbrush holder 10, having generally different shapes. Because of the simple nature of the toothbrush holder 10, a wide variety of patterns may be utilized in creating the embodiment so long as the elements described here and above are applied. FIG. 3 specifically shows an alternative to having a single resting edge, in embodying corresponding points 13 and 15 for resting on a surface such as a counter or sink basin. Hence, the description of the invention is merely exemplary in nature and, thus, variations that do not depart from the gist of the invention are intended to be within the scope of the invention. Such variations are not to be regarded as a departure from the spirit and scope of the invention.

What is claimed is:

1. A portable toothbrush holding device formed of a rigid polymer, for sanitarily holding a toothbrush upon a generally horizontal support surface comprising:

a generally planar, square shaped monolithic body having a first side and a second side, said body being of uniform thickness with a predetermined height to width ratio;

at least one linear edge adapted to bear along its entire length upon said generally horizontal support surface, said linear edge having a bearing surface adapted to rest upon said generally horizontal support surface;

a plurality of different size apertures each extending through said body from said first side to said second side, to accommodate toothbrush handles of different cross-sectional diameters, at least one aperture having a diameter substantially greater than the cross-section of a toothbrush handle, said apertures arranged along a centerline of said toothbrush holding device, said centerline being arranged perpendicular to said bearing surface of said toothbrush holding device; said toothbrush holding device being easily slidable on and off said toothbrush handle, and is intended to be disassembled from toothbrush handle for storage and transportation;

wherein when said toothbrush handle is inserted through one of said apertures, a rigid triangle is formed with one corner comprising the meeting point between the end of the toothbrush handle and the support surface, the second corner comprising the meeting point between the linear edge of said toothbrush holding device and the support surface, the third corner being achieved by one side of the toothbrush handle tightly wedgingly engaging the corner edge defined by one face of the toothbrush holding device and one peripheral portion of the aperture through which said toothbrush handle is inserted, and the opposite side of the toothbrush handle tightly wedgingly engaging the corner edge defined by the opposite face of the toothbrush holding device and the diametrically opposite peripheral portion of said one aperture, wedging the toothbrush handle within said one aperture and rigidly elevating and supporting the bristle end of said toothbrush above said support surface, and wherein said toothbrush handle and said body are moved perpendicular to one another, the wedging engagement between said corner edges of said body and the appropriate side of the toothbrush handle become disengaged and said handle can be easily removed from said one aperture without any interference or engagement between the internal periphery of said one aperture and the external surface of the toothbrush handle.

* * * * *